US008941483B2

(12) United States Patent
Davis

(10) Patent No.: US 8,941,483 B2
(45) Date of Patent: Jan. 27, 2015

(54) HEATING APPLIANCE EMERGENCY REMINDER DETECTION DEVICE

(71) Applicant: Kenneth Davis, Catonsville, MD (US)

(72) Inventor: Kenneth Davis, Catonsville, MD (US)

( * ) Notice: Subject to any disclaimer, the term of this patent is extended or adjusted under 35 U.S.C. 154(b) by 12 days.

(21) Appl. No.: 13/760,267

(22) Filed: Feb. 6, 2013

(65) Prior Publication Data

US 2013/0229278 A1 Sep. 5, 2013

Related U.S. Application Data

(60) Provisional application No. 61/605,894, filed on Mar. 2, 2012.

(51) Int. Cl.

| | |
|---|---|
| ***G08B 19/00*** | (2006.01) |
| ***G08B 21/04*** | (2006.01) |
| ***G08B 21/24*** | (2006.01) |

(52) U.S. Cl.

CPC ..... *G08B 21/0484* (2013.01); *G08B 21/24* (2013.01)

USPC ..... 340/521; 340/573.1; 340/628; 126/42

(58) Field of Classification Search

USPC ..... 340/521, 573.1, 573.4, 628, 632, 506; 126/39, 42; 431/12, 13, 75, 77

See application file for complete search history.

(56) References Cited

U.S. PATENT DOCUMENTS

| | | | | |
|---|---|---|---|---|
| 4,773,485 | A | 9/1988 | Silverman | |
| 4,775,913 | A | 10/1988 | Ekblad | |
| 4,834,188 | A | 5/1989 | Silverman | |
| 5,243,172 | A | 9/1993 | Hazan et al. | |
| 5,294,779 | A | 3/1994 | Miquelot | |
| 5,380,985 | A | 1/1995 | Graham | |
| 5,608,383 | A | 3/1997 | Neil | |
| 5,642,104 | A | 6/1997 | Erwin | |
| 5,697,450 | A | 12/1997 | Stehling et al. | |
| 5,717,188 | A | 2/1998 | Vaillancourt | |
| 5,854,520 | A | 12/1998 | Buck et al. | |
| 5,871,057 | A | 2/1999 | Stehling et al. | |
| 5,945,017 | A | 8/1999 | Cheng et al. | |
| 6,044,913 | A | 4/2000 | Stehling et al. | |
| 6,108,685 | A * | 8/2000 | Kutzik et al. | 709/200 |
| 6,130,413 | A | 10/2000 | Rak | |
| 6,294,994 | B1 | 9/2001 | Hoellerich | |
| 6,323,777 | B1 | 11/2001 | Durston et al. | |
| 7,002,109 | B2 | 2/2006 | Klask | |
| 7,145,462 | B2 * | 12/2006 | Dewing et al. | 340/573.1 |
| 8,610,036 | B2 * | 12/2013 | Ewell et al. | 219/492 |
| 2005/0109333 | A1 * | 5/2005 | Thomas | 126/42 |
| 2012/0132635 | A1 * | 5/2012 | Mishra | 219/209 |

* cited by examiner

*Primary Examiner* — Toan N Pham

(74) *Attorney, Agent, or Firm* — Millen, White, Zelano & Branigan, P.C.; William F. Nixon

(57) ABSTRACT

A device uses motion detection and heat detection to monitor a room and heating appliance and to remind a user to check on the appliance after a period of time. A motion detector sensor observes motion within a room or area by the heating appliance. If someone is in the area, then the device resets itself. If no one is detected, then the device alerts a user if heat is detected by a heat sensor. The alert prevents a possible heating or cooking emergency.

18 Claims, 7 Drawing Sheets

HEATING APPLIANCE EMERGENCY REMINDER DETECTION DEVICE

FIELD OF THE INVENTION

The present invention relates to devices to prevent accidents and fires in a kitchen or other area having heating platforms, such as stoves. More particularly, the present invention relates to a device that incorporates multiple sensors and processes to detect a possible condition and to alert someone about an unattended fire source to prevent the condition from occurring.

DESCRIPTION OF THE RELATED ART

Stove fires and accidents still occur in today's modern kitchen. A user may leave a stove unattended, and forget to return to the kitchen or cooking area to monitor the items being heated. Although this may not result in a fire, it can result in overheating, which ruins food or causes messy spills. Injuries also may occur, and possibility of something catching on fire does exist.

In fact, in 2010, cooking was involved in an estimated 156,400 home structure fires that were reported to U.S. fire departments. These fires caused 410 deaths, 5,310 injuries and $993 million in direct property damage. Cooking caused 44% of reported home fires, 16% of home fire deaths, 40% of home fire injuries, and 15% of the direct property damage in 2010. Estimates show that every 3-4 minutes, an unattended cooking fire ignites in the United States. Ranges account for the majority of home cooking fires, as opposed to ovens, where flames or heat is applied to a pot or pan. Thus, fires still occur while cooking in the kitchen that may lead to serious injury and property damage.

A variety of safety devices and systems are available to prevent serious cooking accidents. Many of these conventional units are built into the stove or heating systems, and are not portable. Moreover, the built-in devices cannot be directed to certain points over the stove as desired by a user. If the built-in device malfunctions, a user probably will not bother to replace the device. These safety devices also do not prevent the emergency condition from happening. Instead, they take action after the emergency starts.

Other conventional cooking safety devices use motion detection to determine whether someone is in the vicinity to check on the stove. Upon detecting motion, the conventional device may reset. Errors may occur when or the device is reset even though the heating appliance has not been checked.

Other conventional cooking safety devices may detect when a critical temperature is reached in order to prevent cooking fires. Though a concern, not all cooking accidents involve fires or hot temperatures. For example, a pot of boiling water may not result in a fire, but can cause serious injury if tipped over. The user is not alerted to the fact that potential boiling water is on the stove, but just if a fire occurs.

SUMMARY OF THE INVENTION

The disclosed embodiments of the present invention pertain to a device that detects heat and motion for cooking safety. The device also implements an algorithm as shown in the disclosed processes to alert the user when needed, but not needlessly or when only severe accidents occur. The present invention incorporates two or more sensors to monitor a confined area to detect and alert a user when a heat source has been unattended for a discrete amount of time.

An unattended heat source may include heat being applied on a stove, grill, fireplace, electric heater and the like. The heat source may include electric or gas sources. The disclosed device detects the presence of the heat being applied in a safe manner, such as heating a pot on a stove. The device then monitors the heat and alerts the user after a period of time has elapsed without user involvement, or no detection of anyone within the immediate vicinity. The user is "alerted" to check on the stove to prevent a condition, such as overheating, burning or a more dangerous situation.

The disclosed device includes a motion sensor to detect motion within a room or confined area. The device may be adjusted to increase the detection area. People moving with the room in the vicinity of the detection area will trigger the motion sensor. The disclosed device also includes a heat sensor to detect heat being turned on and off. Preferably, the heat sensor comprises an infrared (IR) sensor. Both sensors are connected to an integrated circuit or processor that executes an algorithm to determine when to alert the user with a chime or other alarm. The algorithm may be overridden, turned off, or modified by the user.

The disclosed device may be stand-alone, and can be placed on a stove, grill, fireplace, heater and the like such that the sensors have a "line of sight" for the desired area. The disclosed device is adjustable to increase the monitoring area or change the line of sight as desired.

According to the disclosed embodiments, a heating appliance emergency alert device is shown. The heating appliance emergency alert device includes a motion detector sensor to monitor a first area for motion within the first area. The heating appliance emergency alert device also includes a heat sensor to monitor a second area approximately adjacent to a heat source for an appliance. The heating appliance emergency alert device also includes a processor to receive information from the motion detector sensor or the heat sensor over a period of time. The heating appliance emergency alert device also includes an alert means to notify a user based on the received information.

Further according to the disclosed embodiments, an emergency alert device to monitor a heat source is shown. The emergency alert device includes a first sensor to detect motion of a user within a first area. The first area is in front of or adjacent to the heat source. The emergency alert device also includes a second sensor to detect heat from the heat source within a second area smaller than the first area. The emergency alert device also includes a data bus. The emergency alert device also includes a processor coupled to the first and the second sensors via the data bus and configured to receive information from the first sensor and the second sensor over a set period of time. The emergency alert device also includes a chime mechanism to sound an alert based on the information.

Further according to the disclosed embodiments, a method for monitoring a heat source is shown. The method includes monitoring a first area using a motion detector sensor. The method also includes monitoring a second area using a heat sensor for heat from the heat source. The method also includes determining that no motion has occurred within the first area while heat is detected within the second area using information from the monitoring steps. The method also includes alerting a user that a potential emergency condition exists based on the information.

BRIEF DESCRIPTION OF THE DRAWINGS

The accompanying drawings are included to provide further understanding of the invention and constitute a part of the specification. The drawings listed below illustrate embodiments of the invention, and, together with the description disclosed below, serve to explain the principles of the invention, as recited in the claims.

DETAILED DESCRIPTION OF THE PREFERRED EMBODIMENTS

Reference will now be made in detail to the preferred embodiments of the present invention. Examples of the preferred embodiments are illustrated in the accompanying drawings. Alternate embodiments and their equivalents are disclosed without parting from the spirit or scope of the claimed invention. It should be noted that like elements disclosed below are indicated by like reference numbers in the Figures.

Figure 1:
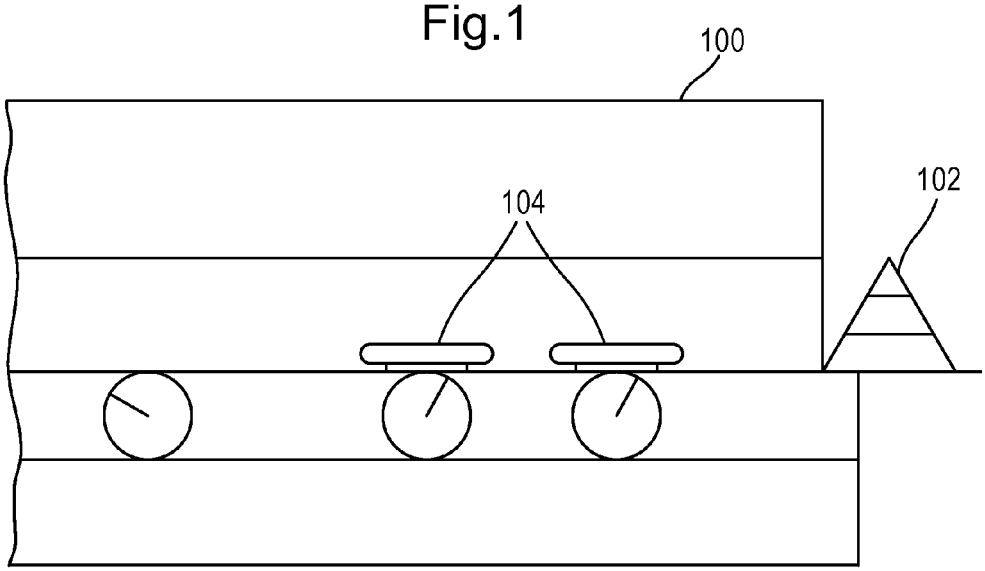
FIG. 1 illustrates a front view of a heating appliance and a detection device according to the disclosed embodiments.

FIG. 1 depicts a front view of a heating appliance 100 and a detection device 102 according to the disclosed embodiments. For simplicity, heating appliance 100 may be referred to as stove 100. Stove 100 includes heating elements 104, also known as burners. Pots, pans, bowls or other kitchen or cookware may be placed on heating elements 104. Heating elements 104 may generate heat using electric or gas power. Heating appliance 100 is not limited to stoves, but may include grills, burners, fireplaces, fire pits, campfire locations, potbelly stoves, space heaters, and the like.

Detection device 102 is located near stove 100, preferably on an adjoining countertop. Detection device 102 also may sit on stove 100 behind or aside heating elements 104. Detection device 102 uses its own power supply, thought it may be plugged into a wall outlet or stove 102. Alternatively, detection device 102 may be built into stove 100, though the remaining description treats device 102 as a stand-alone assembly. If built into stove 100, then detection device 102 draws its power from the same source as the stove.

Detection device 102 may be composed of heat resistant plastic or low heat conductivity metal for its outer materials or housing. These materials protect it from damage or malfunction due to constant exposure to heat. Detection device 102 also may include a heat shield or heat sink to mitigate higher temperatures while cooking takes place near its location.

Figure 2:
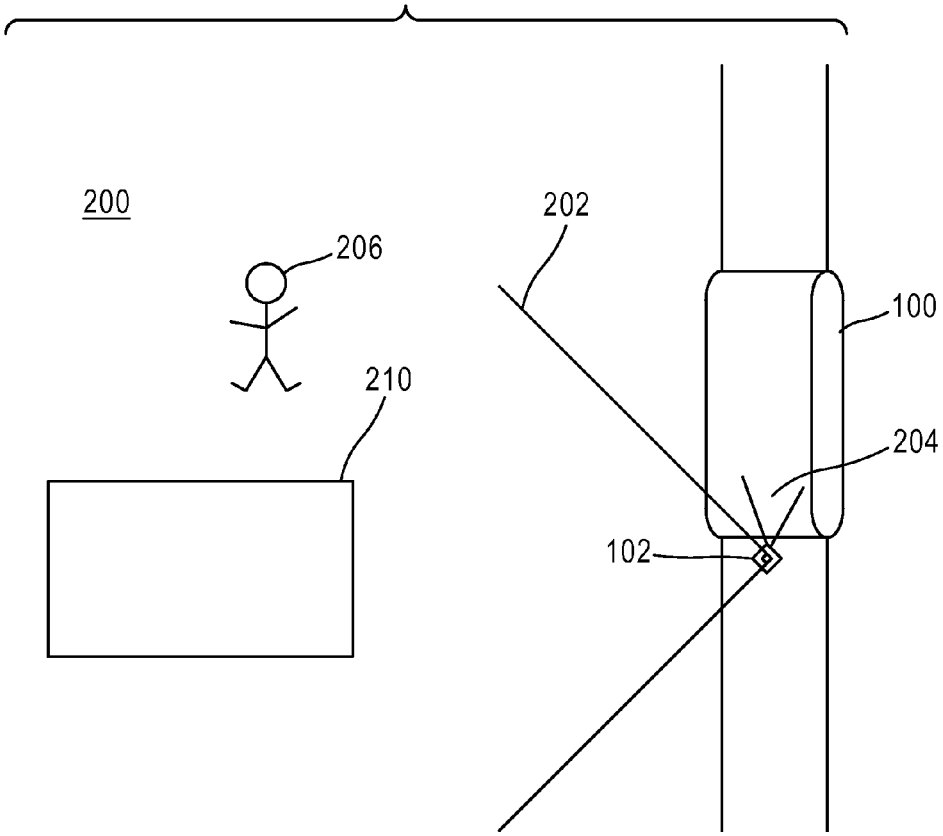
FIG. 2 illustrates a top view of the monitoring areas of the detection device according to the disclosed embodiments.

FIG. 2 depicts a top view of the monitoring areas of detection device 102 according to the disclosed embodiments. Stove 100 may be built into a wall or countertop environment within a kitchen. Area 200 represents the room or vicinity near stove 100. Area 200 may encompass a room, multiple rooms, a backyard and the like. Preferably, area 200 is about 20 to 25 square feet.

Area 200 may include monitoring areas 202 and 204. Monitoring area 202 includes the immediate vicinity near stove 100. Monitoring area 202 preferably encompasses those places near stove 100 that receives foot traffic and a probability of someone walking through it every so often. Detection device 102 is adjustable to increase or decrease the size of monitoring area 202 as desired. Preferably, detection device 102 is offset from stove 100 by enough distance such that monitoring area 202 does not overlap with the heating appliance. Alternatively, any motion detection sensors of detection device 102 are positioned to monitor area 202.

Monitoring area 204 includes the surface of the heating appliance itself, as opposed to the room. Monitoring area 204 preferably is smaller than monitoring area 202. Referring back to FIG. 1, monitoring area 204 includes the locations above heating elements 104. Alternatively, monitoring area 204 includes that area in front or over top of a heating appliance. Preferably, monitoring area 204 includes a plane over the heating elements.

User 206 moves within monitoring area 202 and is detected by detection device 102. Table 210 also may be in monitoring area 202. The ability and ranges for monitoring areas 202 and 204 may be refined or expanded, as needed. In other words, detection device 102 may be configured to provide a specified range within a kitchen to detect motion from user 206 and heat from stove 100. These configurations are disclosed in greater detail below.

Figure 3:
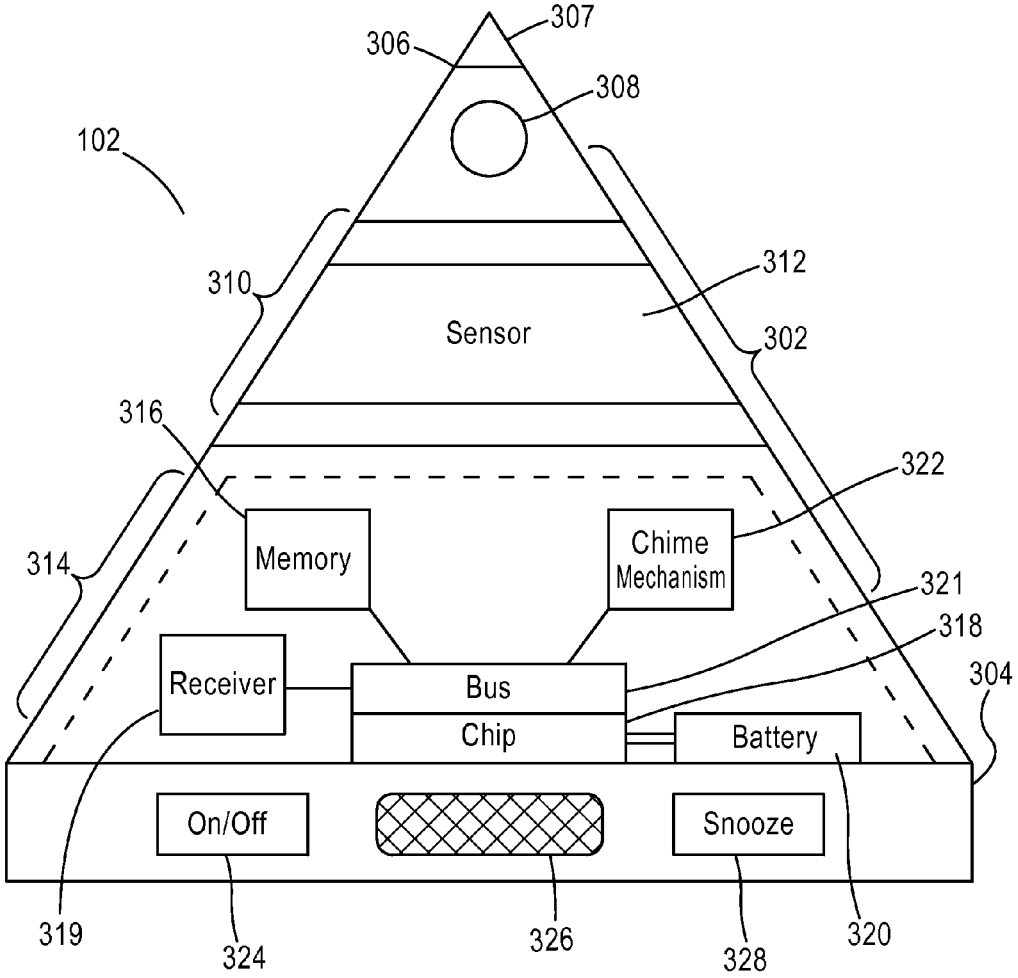
FIG. 3 illustrates the detection device according to the disclosed embodiments.

FIG. 3 depicts detection device 102 according to the disclosed embodiments. Detection device 102 includes components that reside in housing 302 or on a base 304. Detection device 102 may include additional components than the ones shown in FIG. 3. For ease of description, detection device 102 may be divided into a plurality of sections 306, 310 and 314. Each section may have its own function, as disclosed below. Other sections having different functions also may be included. Further, the sections may be configured in any manner, and are not limited to the configuration shown in FIG. 3.

Section 306 performs the motion detection function using motion detector sensor 308. Motion detector sensor 308 may be directional and movable to point at a desired location for monitoring area 202. Section 310 performs the heat detection function using heat sensor 312. Heat sensor 312 also may be known as an IR sensor, though other sensors may be used. Heat sensor 312 resides below motion detection sensor 308. Heat sensor 312 may be configured to detect from all sides of detection device 102, or just from the side facing stove 100. Multiple motion detector sensors 308 may be used at different elevations and angles to provide better coverage of area 202. Multiple heat sensors 312 also may be used.

Section 314 houses the circuitry to perform the detection and alert logic functions. For example, section 314 includes integrated chip or processor 318 that executes the steps for the algorithm and processes disclosed below needed to operate detection device 102. These steps may be stored in memory 316 accessible by processor, or chip, 318.

Processor 318 is electrically connected to sensors 308 and 312 via data bus 321, and receives input signals from each to determine which course of action to take. Data used by processor 318 may be binary, such as a sensor being in an "on" or "off" state according to its status. Alternatively, the sensors may have a threshold that triggers once the threshold is achieved, especially with regard to detecting heat. Once a certain heat threshold is detected, then heat sensor 312 may send an "on" signal to processor 318.

Processor 318 also may determine a voltage level for any signals from detectors 308 and 312. Using the voltage levels, processor 318 determines whether the movement or heat meets threshold levels for action. For example, a voltage level may increase in the signals from heat detector 312 as the detected temperature increases.

Battery 320 supplies power to the components within detection device 102. Chime mechanism 322 may sound a chime or other alert when instructed to by processor 318. Chime mechanism 322 may be an audio circuit or any other device capable of producing sound. Data bus 321 may connect all the various components together, and carry the electric signals to operate these components.

Various buttons or toggle switches may be located on detection device 102. For example, FIG. 3 shows the buttons on base 304. On/off button 324 may disable power from battery 320 to processor 318, thereby turning off detection device 102. Alternatively, on/off button 324 may invoke a sleep mode or standby mode. Speaker 326 may sound the chime as instructed from chime mechanism 322. Speaker 326 may not be a button per se, but one may be able to turn the sound off. Snooze button 328 also may be used to delay the signal or detection period for a set time.

An optional section may be included that allows for communication between detection device 102 and other devices of the user. For example, transceiver 319 may send a message to a user to alert them. Transceiver 319 includes circuitry configured to function as a transmitter or a receiver. Transceiver 319 may send a text message over a cellular network to the user that the stove should be checked. Transceiver 319 also may receive a remote signal to turn detection device 102 "on," thereby bypassing button 324.

Detection device 102 also may include an indicator light 307. Indicator light 307 is located preferably on top of detection device 102, but may be located any place visible to a user. Indicator light 307 visually informs the user that detection device 102 is in an "on" state. Indicator light 307 may be a light-emitting diode (LED), or a plurality of LEDs. Indicator light 307 may institute different colors to visually show the status of the different components of detection device 102. For example, a red light provides feedback that IR sensor 312 is in position to detect the heat source, or that it is working.

Motion detector sensor 308 may toggle an amber light of indicator light 307 to indicate that it is working. Thus, when the user turns on detection device 102, indicator light 307 provides immediate feedback as to whether it is positioned properly, and that the sensors are working. Indicator light 307 also may visually prompt the user that battery 320 is low. A test button, such as button 324, may be pressed to test detection device 102 by reading the states of heat sensor 312 and motion detector sensor 308 over a time interval. If the test passes, then indicator light 307 may come on, and chime mechanism 322 may sound. Preferably, this interval is about 30 seconds.

Figure 4:
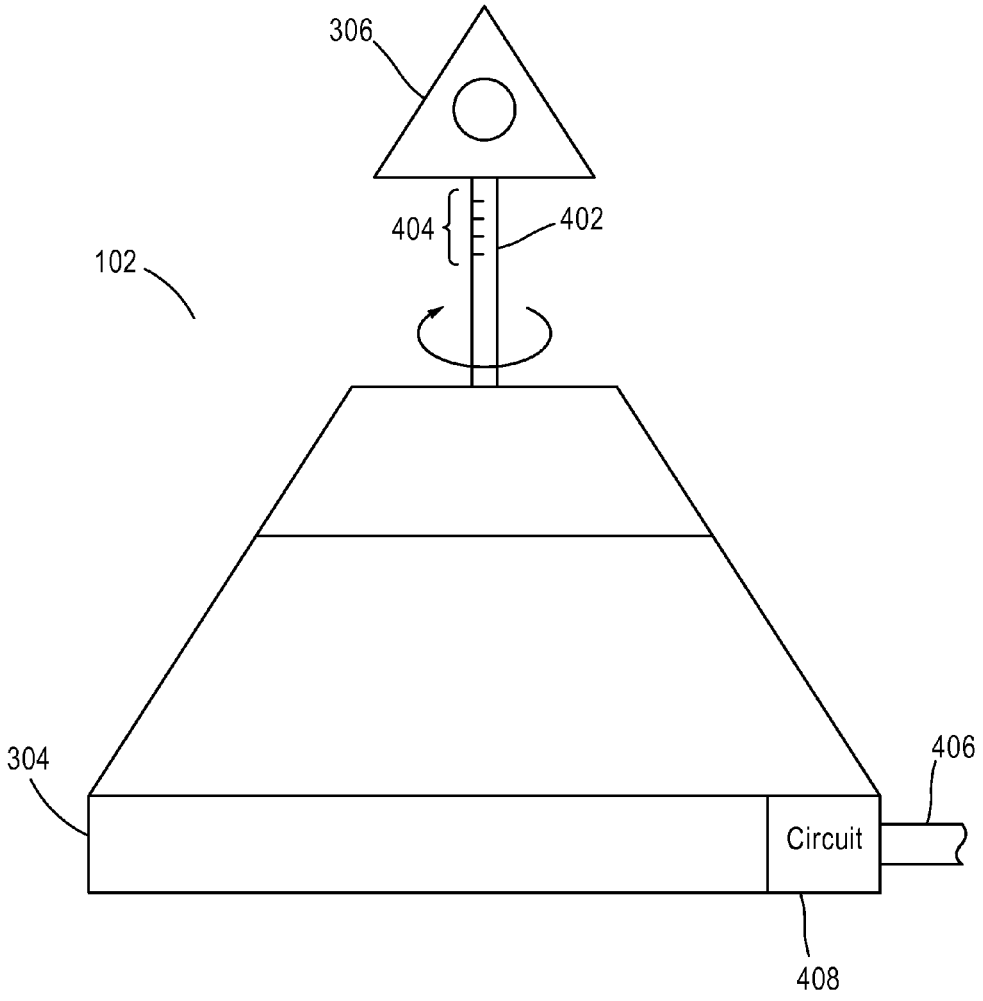
FIG. 4 illustrates another embodiment of detection device having the motion sensor elevated according to the disclosed embodiments.

FIG. 4 depicts another embodiment of detection device 102 that allows motion detector sensor 308 to be elevated to increase monitoring area 202. Extension rod 402 may adjust the height of section 306 so a greater area can be monitored, or to overlook obstacles, such as pots, pans, dishes, and the like. Extension rod 402 also may be rotatable so as to direct motion sensor 308 in a desired direction.

If detection device 102 includes multiple sensors, then these sensors may be positioned using extension rod 402 to provide the best coverage of monitoring area 202. A motion detector sensor 308 may be installed on each side of section 306, or possibly three sides to allow one side to face a wall. Further, heat sensor 312 may face towards the stovetop, while motion detector sensor 308 is turned toward the room for monitoring using rod 402.

Extension rod 402 may be comprised of metal to provide sufficient stability to section 306. Extension rod 402 may include notches 404 to indicate a position to the user, and to secure the rod to detection device 102. Extension rod 402 also may be composed of plastic or any other material. Preferably, extension rod 402 provides a connection to data bus 321 so that motion detector sensor 308 may send signals to processor 318.

FIG. 4 also depicts an optional alternating current (AC) power capability for detection device 102. AC power may reduce the drain of battery life and reduce the need to replace battery 320. It also may be used to power transceiver 319 for communications within a network or to the user. Thus, as disclosed below, when AC power is available to detection device 102, transceiver 319 may be activated to join a wireless network. Otherwise, detection device 102 is kept "offline" to conserve battery power.

As shown, AC power cord 406 attaches detection device 102 to an appropriate power outlet. AC power cord 406 may be attached to detection device 102 during manufacture, or may plug into the device using a port or adapter to receive the cord. Detection device 102 also includes AC power convertor circuitry 408 that converts the AC power to direct current (DC) power better suited for use by the components within detection device 102. For example, circuitry 408 may provide power to processor 318, data bus 321, transceiver 319, and the like. Circuitry 408 also may electronically couple to battery 320 to recharge the battery when AC power cord 406 is connected.

AC power cord 406 and AC power convertor circuitry 408, along with battery 320, allows for a variety of power options when using detection device 102. If used on a stove with access to a wall outlet, then AC power may be used to save battery life and improve functionality. Battery 320 may be used for power when the heat source is in actual use, and detection device 102 needs to be moved away from the outlet for better detection results. Battery 320 also may be used when the heat source is a fireplace or grill that is not near an AC power outlet.

Detection device 102 may include a feature to secure it to a surface so that the device is not easily shifted. For example, one may bump detection device 102 and shift monitoring areas 202 and 204. Such an occurrence may result in non-detection of potential harmful condition on the heating appliance. Thus, adhesive or suction cup(s) may be placed on the bottom of detection device 102 to better stabilize the device. Rubber or plastic strips also may be used.

Figure 5:
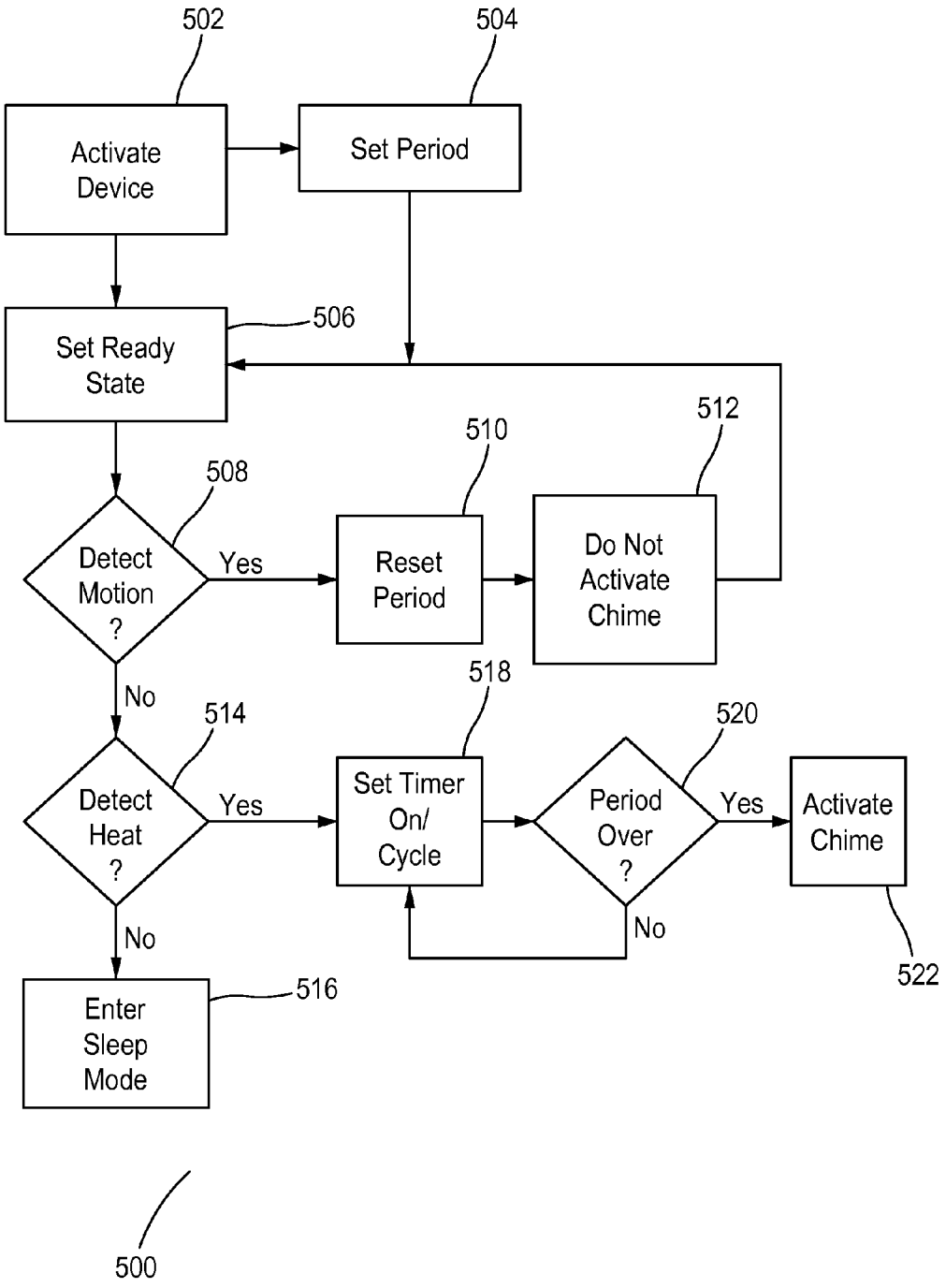
FIG. 5 illustrates a flowchart of a process for alerting or reminding a user while a heating appliance is activated according to the disclosed embodiments.

FIG. 5 depicts a flowchart 500 of a process for alerting or reminding a user that a heating appliance is activated according to the disclosed embodiments. Flowchart 500 may be implemented as steps stored in memory 316, and executed by processor 318. Any software or instructions stored in memory 316 may come with detection device 102, or downloaded from a central server, either when the device is finished, or after purchase by a user. Moreover, software and instructions may be downloaded as an application from remote source, provided that detection device 102 has a connection to a network.

Step 502 executes by activating detection device 102. This may be accomplished by pressing on/off button 324. Step 504 executes by setting a period for waiting before alerting or reminding a user. This period may be adjustable, or defaulted to 15 minutes. Alternatively, step 504 may be skipped and a set time used for the monitoring.

Step 506 executes by setting detection device 102 into a ready state. In other words, detection device 102 and processor 318 is "on" and ready to monitor signals from the sensors. A counter starts for the period set above, or a default period. Step 508 executes by determining whether motion is detected by motion sensor 308. If yes, then step 510 executes by resetting a count to zero (0) to start the monitoring period over again. Step 512 executes by not activating chime mechanism 322 as a person was detected in the vicinity of the heating appliance.

If step 508 is no, then step 514 executes by determining if heat is detected on the heating elements of the heating appliance using heat sensor 312. By being "no," step 508 indicates that no person has been in the area for a specified period of time. If heat is detected in this period, then an alert may be needed to remind the user that heat is on. If step 514 is no, then step 516 executes by placing detection device 102 into a sleep mode or to continue monitoring.

If step 514 is yes, then step 518 executes by setting the time period using a timing function and cycling through the period of monitoring. Step 520 executes by determining whether the period is over. If yes, then step 522 executes by activating chime mechanism 322. Chime mechanism 322 may escalate in volume after a set period of time that the user does not reset the device. For example, chime mechanism 322 may increase in volume after 30 seconds or a minute passes without user involvement. Other audio alerts may be used to remind the user.

Alternatively, a light or other visual indication, as disclosed above with regard to indicator light 307, may be activated to alert the user that the heat is still on, and no one has been in the vicinity recently. Indicator light 307 may "strobe" or flash on and off rapidly to better grab the attention of a user. This function better alerts those users having hearing impaired issues, or possibly not close enough to hear chime mechanism 322, but can see detection device 102. Further, transceiver 319 may be used to alert the user over a network or wireless connection. If the condition is no, then step 520 returns to step 518.

Figure 6:
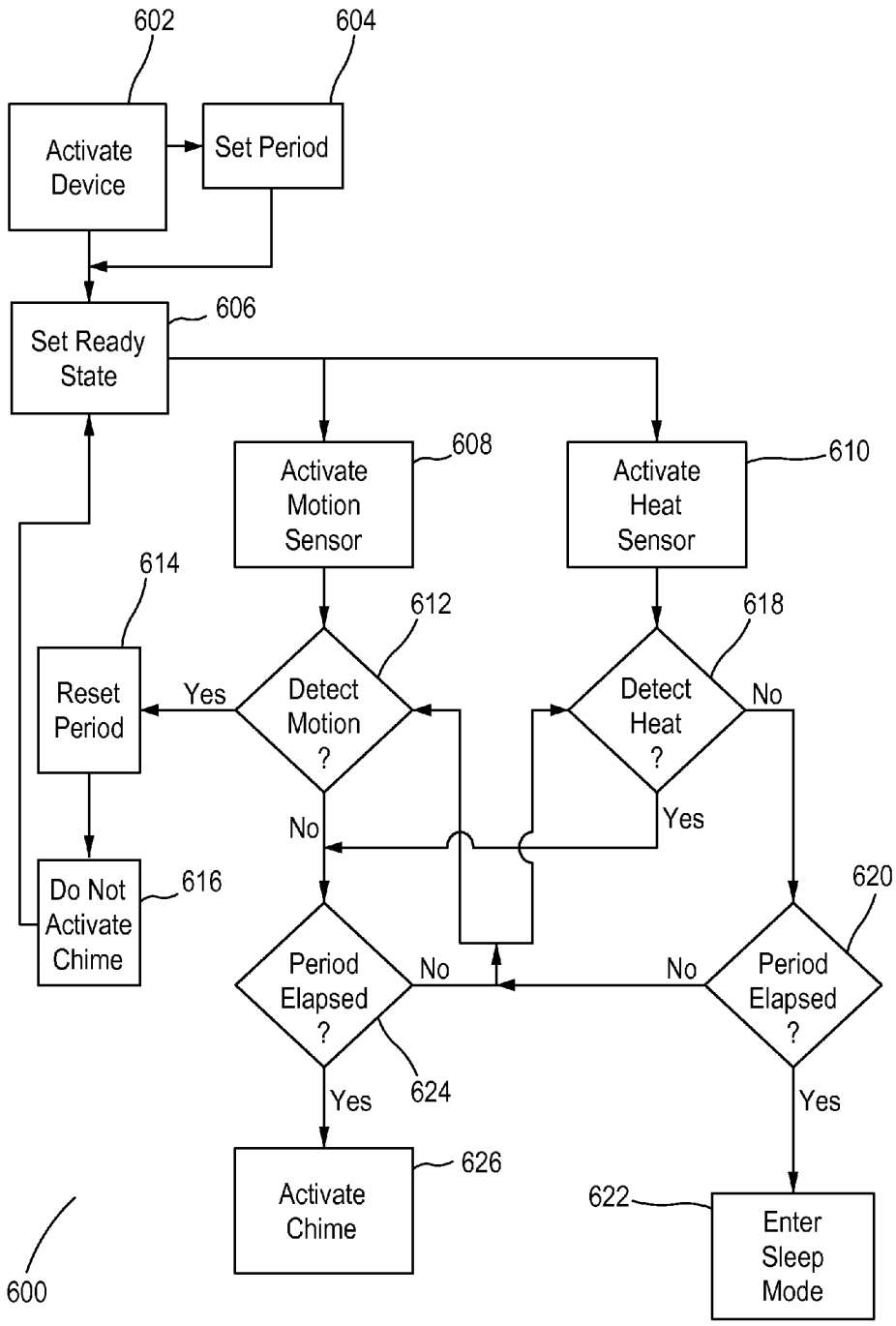
FIG. 6 illustrates a flowchart of another process for alerting or reminding a user while a heating appliance is activated according to the disclosed embodiments.

FIG. 6 depicts a flowchart 600 of another process for alerting or reminding a user while a heating appliance is activated according to the disclosed embodiments. Flowchart 600 also may be executed as steps stored in memory 316, and executed by processor 318. Step 602 executes by activating detection device 102. Step 604 executes by setting a period for waiting before alerting or reminding a user, as disclosed above.

Step 606 executes by setting a ready state for detection device 102 to monitor conditions within the prescribed areas. Step 608 executes by activating motion sensor 308. Step 610 executes by activating heat, or IR, sensor 312. These steps may be executed in parallel, so that both sensors come on at the same time. The resulting steps involved these sensors also may be executed in parallel so that motion and heat detection occurs simultaneously.

Step 612 executes by determining whether motion is detected by motion sensor 308. Motion may be detected when a user passes in the detection range of sensor 308. The range may be about 20 to 25 feet. If so, then step 614 executes by resetting the period back to zero (0) and beginning the period over. In other words, detection device 102 determines that an alert is not needed unless another set period, such as 15 minutes, passes with no detection of motion. Step 616 executes by not activating chime mechanism 322, or any other reminder operation. Flowchart 600 then may flow back to step 606 to place device 102 into a ready state. If step 612 is no, then flowchart 600 goes to step 624, disclosed below.

Step 618 executes by determining whether IR sensor 312 detects heat within its detection area. If no, then this means that the stove or appliance is not turned on and there is no need to alert a user. Thus, step 620 may be executed to determine whether the specified time period has elapsed so that device 102 may enter a sleep or low power mode to conserve energy. If the time period has lapsed, then step 622 executes by entering a sleep mode.

If step 618 is yes, then that indicates a heat source has been detected. Someone is applying heat. Flowchart 600 continues to step 624. Step 624 executes by determining whether the set time period has elapsed when step 612 is no and heat has been detected. If no, then step 624 returns flowchart 600 to steps 612 and 618 to continue monitoring. If step 620 is no, then it also returns flowchart 600 to steps 612 and 618.

If step 624 is yes, then this indicates that an alert condition is detected. The user is reminded that the heating appliance is in use and should be checked. Step 626 executes by activating chime mechanism 322. Thus, the motion and heat detection processes may be executed in parallel.

Other factors and conditions also may be taken into account. For example, detection device 102 may include a light sensor to detect if light is on within area 202. If so, then chime mechanism 322 may not alert the user until no light has been detected within the set period along with no motion and heat.

Figure 7:
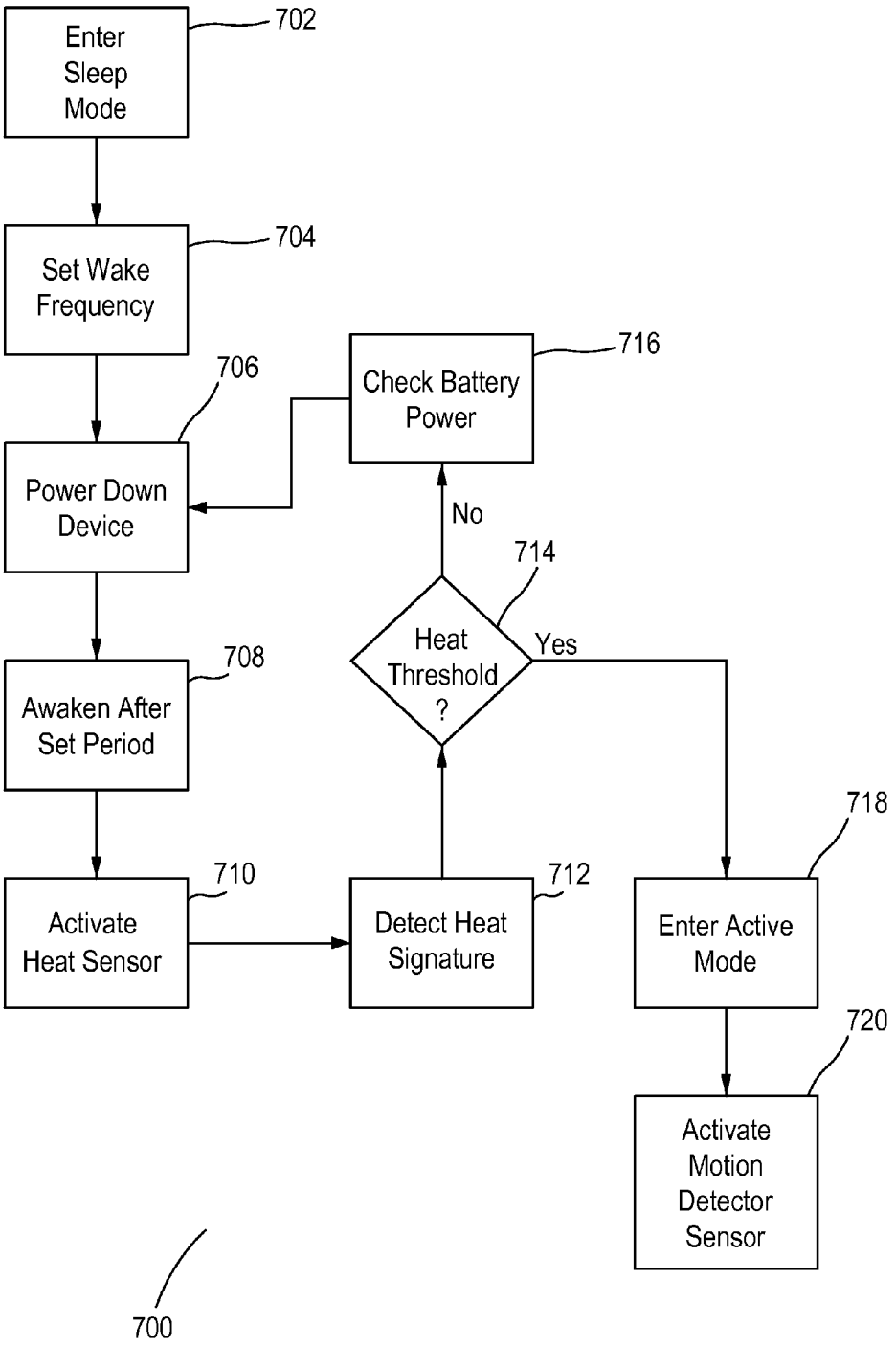
FIG. 7 illustrates a flowchart of a process for activating a detection device by detecting heat over a period of time according to the disclosed embodiments.

FIG. 7 depicts a flowchart 700 for activating detection device 102 by detecting heat over a period of time according to the disclosed embodiments. The process disclosed by flowchart 700 may be used to have detection device 102 to come on automatically due to detecting a heat source without adversely increasing power consumption or draining the life of battery 320. Preferably, detection device 102 may operate for several months to over a year without replacement of battery 320 while providing around the clock detection of fires within monitoring area 204.

Step 702 executes by having detection device 102 enter a sleep mode. "Sleep mode" may refer to a state that, after a period of time without use, detection device 102 invokes. Step 704 executes by setting a wake frequency that detection device 102 will use while in sleep mode. In other words, detection device 102 will "awaken" or activate every so often to perform operations. Preferably, this period between activations is about one hour. The activation frequency may be set at the factory, or by the user. This period also may vary due to time of day. For example, detection device 102 may "awaken" every 15 minutes during the period between 5 and 9 p.m.

Step 704 may be executed apart from the other steps in flowchart 700, but is shown here to indicate that the frequency of performing detection operations may be set. Other embodiments include setting the frequency or times for activation as once or more, and then stopping once the number of activations is complete. This data may be stored in memory 316 and used by processor 318.

Step 706 executes by powering down detection device 102 to save energy and battery life. During this state, motion detector sensor 308 and heat sensor 312 are off. Minimal power is supplied to processor 318 and other components, but detection device 102 is not monitoring any areas. The period before powering down may be set, for example as 10 minutes. The period may decrease as battery life decreases, so that detection device 102 powers down before battery life is exhausted.

Step 708 executes by awakening after the set period specified above. As noted, this period may be every hour, or varied as desired. Step 710 executes by activating IR sensor 312 or sensors if multiple IR sensors are used. Step 712 executes by detecting any heat signature being given off within monitoring area 204. If heat is being applied by heating appliance 100, then detection device 102 may detect such activity. This activity is monitored to prevent a cooking fire.

Step 714 executes by determining whether any heat signatures or activity detected exceeds a heat threshold. For example, the disclosed embodiments seek to detect heat being applied on a stove, but not the body heat signature of someone by the stove or a cup of coffee in monitoring area 204. Thus, the heat threshold may be set to discriminate from non-fire causing activities and to prevent false alarms. Preferably, the heat threshold for any heat signatures detected by heat sensor 312 is between 100 and 120 degrees Fahrenheit. This value should eliminate humans, pets, cups of coffee and the like from inadvertently activating detection device 102.

Moreover, the heat threshold may be adjusted for the offset distance between detection device 102 and heating appliance 100. Preferably, the 100 degree threshold applies to an offset distance of about 36 inches. The greater the distance between detection device 102 and heating appliance 100, then the lower the temperature sensed by IR detector 312. If detection device 102 is close, such as 12 inches, to heating appliance 100, then the heat threshold for activation may be set higher. The heat threshold may be set by the user, or be a factory setting. Preferably, the heat threshold is installed as a default value that is adjustable by the user.

If step 714 is no, then any detected activity is below the amount usually associated with potential fires on heating appliance 100. There is no need to activate detection device 102. Flowchart 700 then returns to step 706 to await another inactive period before performing another check.

If step 714 is yes, then activity on heating appliance indicates that it should be monitored, and detection device 102 turned on. Thus, step 718 executes by entering active mode, and performing the steps to detect a possible emergency condition, as disclosed above. Full power is applied to the components of detection device 102. Thus, step 720 executes by activating motion detector sensor 308, for example.

The sleep mode operation of detection device 102 may be modified depending on the situation such that false alarms or non-detected fires are minimized. For example, detection device 102 may activate only once every several hours for an outdoor fire pit as opposed to a stove in kitchen. The heat threshold may be adjusted higher if the device comes on too frequently during everyday operations.

Figure 8:
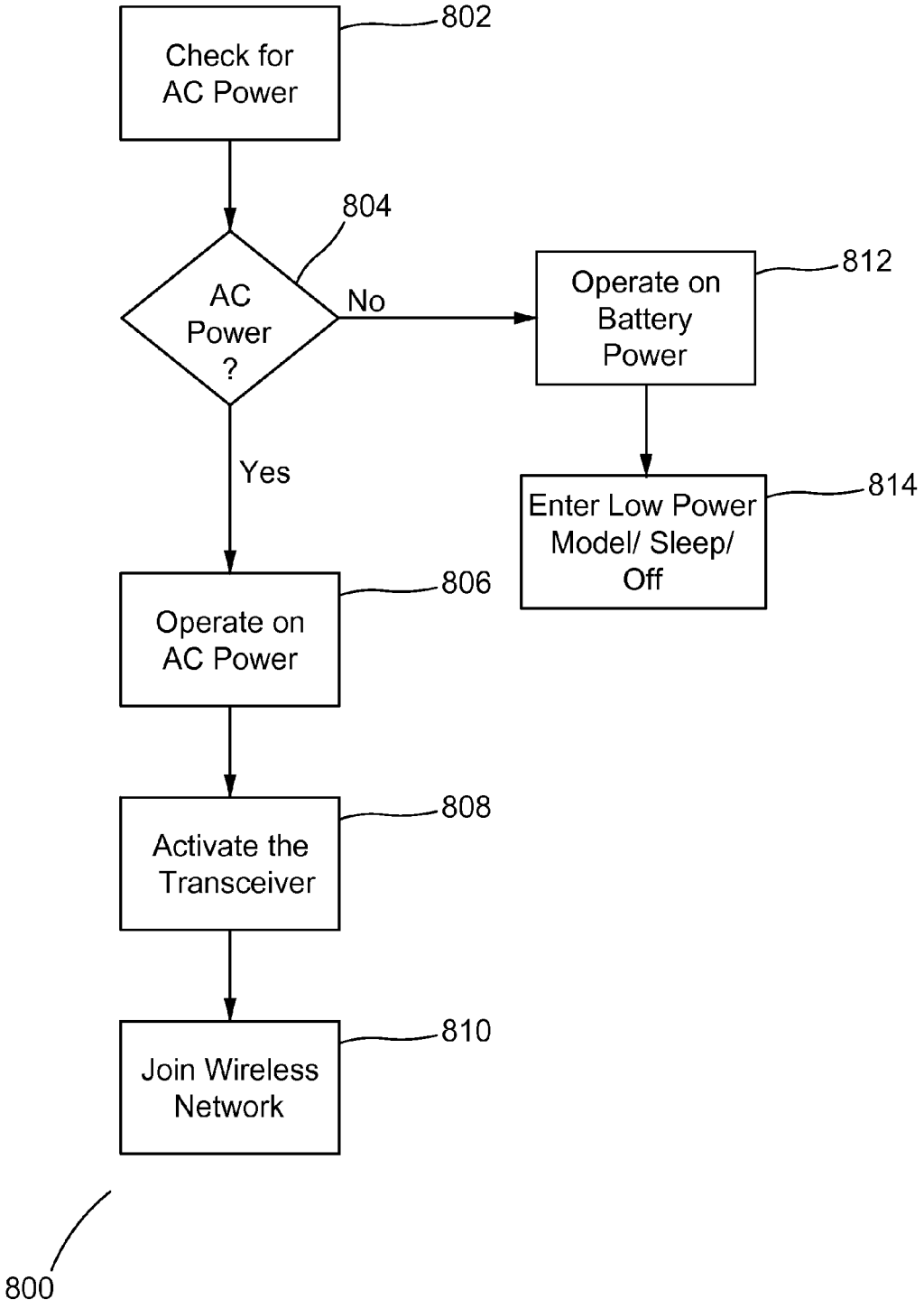
FIG. 8 illustrates a flowchart of a process for entering a power mode for the detection device according to the disclosed embodiments.

FIG. 8 depicts a flowchart 800 for entering a power mode for detection device 102 according to the disclosed embodiments. As disclosed above, detection device 102 may use AC or battery power, depending on the situation. Detection device 102 may be plugged into an outlet while inside, but switch to battery power when used outside. Further, detection device 102 may be moved closer during cooking operations to a stove, and, thus, not able to reach a power outlet. The disclosed embodiments allow detection device 102 to determine the availability of power to select which mode to use.

Step 802 executes by checking for AC power coming into detection device 102. Preferably, circuit 408 can provide an indication to processor 318 that AC power is being supplied. Step 804 executes by determining whether AC power is detected. If yes, then step 806 executes by operating detection device 102 on the AC power. More specifically, incoming AC power is converted to DC voltage to supply the components. Battery 320 may be recharged using the supplied power.

Step 808 executes by activating transceiver 319. Transceiver 319 may be in an "off" state to conserve energy and not drain battery 320 when AC power is not available. This step turns it on to resume communications with a user. Step 810 executes by joining a wireless network, if applicable. Transceiver 319 may include a key to access a local area network. If a wireless network is detected, transceiver 319 uses the key to access the network and send communications to the user. These communications may include messages that detection device 102 is on, or to check on heating appliance 100.

If step 804 is no, then it is determined that AC power is not available. Thus, step 812 executes by operating detection device 102 on power from battery 320. Preferably, this power does not need to be converted to DC voltage, and may flow directly to the components disclosed above. Step 814 executes by entering detection device, and processor 318, into a set mode, such as sleep mode, low power mode, "off" mode, and the like. Detection device 102 may run the processes disclosed above to detect heat and motion when turned "on" by the user.

In addition to being implemented as a device and associated processes, the disclosed embodiments may be provided as a program product stored on a computer-readable medium, which, when executed, enables detection device 102 to operate in the manner disclosed above. To this extent, the computer-readable medium may include program code, which implements the processes and functionality disclosed herein.

The term "computer-readable medium" includes one or more of any type of physical embodiment of the program code implementing the steps to execute the disclosed processes. The computer-readable medium accessible or incorporated in detection device 102 may comprise program code embodied on one or more portable storage articles of manufacture, such as a compact disc, a DVD, a Blu-ray disc, a magnetic disk, a tape and the like, or one or more data storage portions of a computing device, such as memory, like memory 316 disclosed above.

As used herein, the terms "program code" and "computer program code" are synonymous and refer to any expression, in any language, code or notation, of a set of instructions that cause detection device 102 having an instruction processing capability to perform a particular function either directly or after any combination of the following: (a) a conversion to another language, code or notation; (b) reproduction in a different material form; or (c) decompression.

To this extent, program code can be embodied as one or more types of program products, such as an application/software program, component software/library of functions, a basic input/output system/driver for a particular computing or I/O device, and the like. Terms such as "component" and "system are synonymous as used herein and represent any combination of hardware or software capable of performing the disclosed function(s).

The block diagrams shown in the Figures illustrate the configuration, functionality and operation of possible implementations of detection device 102. Flowcharts 500, 600, 700 and 800 disclose possible processes implemented by program code or instructions stored or accessible by detection device 102.

Each block in the flowcharts may represent a module, segment or portion of code, which comprises one or more executable instructions for implementing the specified logical function(s). The functions noted in the blocks may occur out of order from that shown in the Figures. For example, two blocks shown in succession may be executed substantially concurrently, or the blocks may sometimes be executed in reverse order, depending on the functionality involved. Each block of the flowcharts can be implemented by special purpose hardware-based systems and circuitry that perform the specified functions or acts, or combinations of special purpose hardware and computer instructions.

It will be apparent to those skilled in the art that various modifications can be made in the disclosed embodiments of the present invention without departing from the spirit or scope the claims. Thus, it is intended that the present invention covers these modifications of embodiments disclosed above provided that they come within the scope of the claims and their equivalents.

What is claimed is:

1. A heating appliance alert device offset from a heat source, the device comprising:

a motion detector sensor to monitor a first area for motion within the first area;

an extension rod coupled to the motion detector sensor adjustable to provide a view of the first area;

a heat sensor to monitor a second area approximately adjacent to a heat source for an appliance;

a processor to receive information from the motion detector sensor or the heat sensor over a period of time; and an alert means to notify a user based on the received information.

2. The device of claim 1, further comprising a battery to power the processor.

3. The device of claim 1, further comprising a housing to enclose the processor, the sensors, and the alert means.

4. The device of claim 1, wherein the alert means comprises a chime mechanism, an indicator light or a transceiver.

5. The device of claim 1, further comprising a transceiver to connect to a wireless network.

6. The device of claim 1, wherein the motion detector sensor is located above the heat sensor.

7. The device of claim 1, wherein the heat sensor includes at least one infrared (IR) detector.

8. The device of claim 1, wherein the motion detector sensor includes a plurality of motion detectors.

9. The device of claim 1, wherein the motion detector sensor is positionable to monitor the first area.

10. The device of claim 1, wherein the heat sensor is configured to detect the heat source having a temperature at or above a heat threshold within the second area.

11. An emergency alert device to monitor a heat source, wherein the device is offset from the heat source, the device comprising:

a first sensor to detect motion of a user within a first area, wherein the first area is in front of or adjacent to the heat source;

an extension rod coupled to the first sensor adjustable to provide a view of the first area;

a second sensor to detect heat from the heat source within a second area smaller than the first area;

a data bus;

a processor coupled to the first and the second sensors via the data bus and configured to receive information from the first sensor and the second sensor over a set period of time; and a chime mechanism to sound an alert based on the information.

12. The device of claim 11, further comprising an indicator light to display the alert based on the information received at the processor.

13. The device of claim 11, further comprising a memory coupled to the data bus configured to store the set period of time.

14. A method for monitoring a heat source, the method comprising:

monitoring a first area using a motion detector sensor offset from the heat source and an extension rod adjustable to provide a view of the first area;

monitoring a second area using a heat sensor offset from the heat source to detect heat from the heat source;

determining that no motion has occurred within the first area while heat is detected within the second area using information from the monitoring steps; and alerting a user that a potential emergency condition exists based on the information.

15. The method of claim 14, further comprising activating the motion detector sensor upon detection of heat from the heat source.

16. The method of claim 14, wherein the alerting step includes activating a chime mechanism.

17. The method of claim 16, further comprising increasing a volume of the chime mechanism.

18. The method of claim 14, further comprising determining that a temperature coming from the heat source exceeds a heat threshold.

* * * * *